US010906678B2

(12) United States Patent
Liao et al.

(10) Patent No.: US 10,906,678 B2
(45) Date of Patent: Feb. 2, 2021

(54) INFLATING STICK AND PROCESSING MACHINE

(71) Applicants: AIR-BAG PACKING CO., LTD., New Taipei (TW); Tai-An Liao, New Taipei (TW)

(72) Inventors: Tai-An Liao, New Taipei (TW); Kao-Hsiung Liao, New Taipei (TW); Chieh-Hua Liao, New Taipei (TW)

(73) Assignees: AIR-BAG PACKING CO., LTD., New Taipei (TW); Tai-An Liao, New Taipei (TW)

( * ) Notice: Subject to any disclaimer, the term of this patent is extended or adjusted under 35 U.S.C. 154(b) by 201 days.

(21) Appl. No.: 16/014,816

(22) Filed: Jun. 21, 2018

(65) Prior Publication Data

US 2018/0297729 A1 Oct. 18, 2018

Related U.S. Application Data

(63) Continuation-in-part of application No. 15/354,582, filed on Nov. 17, 2016, now abandoned.

(30) Foreign Application Priority Data

Nov. 19, 2015 (TW) ..... 104138357 A

(51) Int. Cl.
*B65B 43/12* (2006.01)
*B65D 81/05* (2006.01)
(Continued)

(52) U.S. Cl.
CPC ..... *B65B 43/123* (2013.01); *B31B 70/20* (2017.08); *B31D 5/0039* (2013.01);
(Continued)

(58) Field of Classification Search
CPC .. B31D 5/0073; B31D 5/0078; B65B 43/123; B65D 81/03
See application file for complete search history.

(56) References Cited

U.S. PATENT DOCUMENTS 157,828 A * 12/1874 Hoskin ..... F16L 15/004 285/333
597,000 A * 1/1898 Higbee ..... F16L 15/004 285/333
(Continued)

FOREIGN PATENT DOCUMENTS

CN 204026128 U 12/2014
GB 2384459 A 7/2003
(Continued)

OTHER PUBLICATIONS

Search report issued in corresponding European patent application dated Apr. 25, 2017 and Office action issued in corresponding Japanese application dated Oct. 3, 2017.
(Continued)

*Primary Examiner* — Andrew D St.Clair
(74) *Attorney, Agent, or Firm* — Rabin & Berdo, P.C.

(57) ABSTRACT

An inflating stick and a processing machine are provided. The inflating stick includes a body, a link rod, a cutter, and one or more inflating tubes. A front end of the body includes a guiding segment with a cone structure. A rear end of the body includes a packing segment. The body includes a gas inlet formed on the packing segment, an internal chamber allowing gas to flow into through the gas inlet, and gas outlets formed on an outer wall of the body allowing gas to flow out. The packing segment includes a first locking structure and a second locking structure. The first locking structure and the second locking structure communicate with the gas inlet. The second locking structure is detachably
(Continued)

fastened to the first locking structure. The link rod and the cutter are disposed in rear of the body. The inflating tube is connected to the gas inlet.

8 Claims, 19 Drawing Sheets

(51) Int. Cl.

| | |
|---|---|
| ***B65D 81/03*** | (2006.01) |
| ***B31B 70/20*** | (2017.01) |
| ***B31D 5/00*** | (2017.01) |
| *B65D 30/24* | (2006.01) |
| *B31B 100/00* | (2017.01) |

(52) U.S. Cl.
CPC ..... *B31D 5/0073* (2013.01); *B65D 81/03* (2013.01); *B65D 81/052* (2013.01); *B31B 2100/00* (2017.08); *B31D 2205/0023* (2013.01); *B31D 2205/0052* (2013.01); *B65D 31/142* (2013.01)

(56) References Cited

U.S. PATENT DOCUMENTS

| | | | | |
|---|---|---|---|---|
| 5,261,466 | A | 11/1993 | Koyanagi | |
| 2006/0042184 | A1* | 3/2006 | Perkins | B31D 5/0073 53/79 |
| 2008/0029162 | A1* | 2/2008 | Wetsch | B31D 5/0073 137/223 |
| 2014/0261871 | A1* | 9/2014 | Wetsch | B31D 5/0073 141/10 |
| 2017/0144402 | A1* | 5/2017 | Liao | B65D 31/14 |

FOREIGN PATENT DOCUMENTS

| | | | |
|---|---|---|---|
| JP | S5050195 | A | 5/1975 |
| JP | 2009078537 | A | 4/2009 |
| JP | 2015013668 | A | 1/2015 |
| WO | WO-2008036641 | A2 | 3/2008 |

OTHER PUBLICATIONS

Taiwan Patent Office, Office Action, Patent Application Serial No. TW104138357, dated Sep. 5, 2016, Taiwan.

* cited by examiner

INFLATING STICK AND PROCESSING MACHINE

CROSS-REFERENCE TO RELATED APPLICATION

This application is a continuation-in-part (CIP) of application Ser. No. 15/354,582, filed on Nov. 17, 2016 with claiming foreign priority of TW104138357. The prior application is herewith incorporated by reference in its entirety.

BACKGROUND

Technical Field

The instant disclosure relates to an inflating structure of a gas sealed body and, more particularly, to an inflating stick and a processing machine.

Related Art

At present, equipment for manufacturing inflated package bags includes a front end for placing work pieces, a processing platform, and a rear retrieving rack. The processing platform receives package bags not inflated from the front end. An inflating device on the processing platform inflates the package bags. The inflated package bags are continuously transported to the rear retrieving rack to be retrieved and reeled in.

Please refer to FIG. 1. FIG. 1 is a top view of continuous sealed bags. U.S. Pat. No. 5,261,466 discloses a process for continuously inflating gas into sealed bags. An inflating device B on a processing platform A in the prior art is a tube structure B1. The tube structure B1 inflates gas into an inflating channel D1 of a package bag D. The flow rate of the gas in the inflating process cannot be adjusted by the tube structure B1. When the package bags D on the processing platform A have wrinkles or are packed together, the conventional tube structure B1 having only one gas outlet cannot make a wrinkle area smooth. If situations causing the package bags to have wrinkles or be packed together are not solved, the process may not work well and may cause danger. Therefore, the artisan in the art tries to design an inflating stick and a processing machine capable of having the wrinkle area formed on the package bags become smooth during the process of inflating the package bags.

SUMMARY

To address the above issue, the instant disclosure provides an inflating stick comprising a body, a link rod, a cutter, and at least one inflating tube. A front end of the body comprises a guiding segment with a cone structure. A rear end of the body comprises a packing segment of which an external diameter is greater than that of the guiding segment. The body comprises a gas inlet formed on the packing segment. The body further comprises an internal chamber allowing gas to flow into through the gas inlet and a plurality of gas outlets formed on an outer wall of the body allowing gas to flow out. Wherein the packing segment comprises a first locking structure and a second locking structure, the first locking structure and the second locking structure communicate with the gas inlet, and the second locking structure is detachably fastened to the first locking structure. The link rod extends outwardly from the rear end of the body. The cutter is disposed in rear of the body and between the packing segment and the link rod. The at least one inflating tube is connected to the gas inlet of the packing segment for supplying gas to the internal chamber.

In some embodiments, the whole body is a long cone. The body further comprises a dividing block. The dividing block is disposed in the internal chamber divided into two corresponding inflating sections. An outside end of the dividing block is at the gas inlet to form at least two openings. The at least two openings are respectively connected to at least two of the inflating tubes. Additionally, the inflating stick further comprises a plurality of switch valves. Each of the switch valves is individually disposed on each of the inflating tubes to enable or disable an inflating process of gas.

In some embodiments, the body is made by a plurality of spheres connected in series. Sizes of the spheres in series gradually increase. The guiding segment is at the smaller spheres, and the packing segment is at the larger spheres.

In some embodiments, the front end of the body is a cone, and a middle part of the body to the rear end of the body is a tube.

The instant disclosure further provides a processing machine comprising a front platform, the aforementioned inflating stick, a base, and a rear retrieving rack. The front platform comprises a transport wheel and a processing platform. The transport wheel transports a gas sealed body not inflated to the processing platform. The link rod of the inflating stick is fixed to the processing platform. The guiding segment of the body is inserted into an inflating channel of the gas sealed body. The base comprises a first fixing structure. The base is disposed on a side of the processing platform. The transport wheel comprises a second fixing structure. The second fixing structure is detachably fixed to the first fixing structure. The rear retrieving rack comprises a retrieving wheel. The retrieving wheel retrieves and reels in the gas sealed body being inflated.

In some embodiments, the processing machine further comprises a plurality of pressing wheels. The pressing wheels are next to the inflating stick. Each of the pressing wheels individually presses an upper side and a lower side of the gas sealed body and transports the horizontal gas sealed body to the rear retrieving rack.

In some embodiments, the processing machine further comprises a plurality of pressing wheels. The pressing wheels are next to the inflating stick. Each of the pressing wheels individually presses a front side and a rear side of the gas sealed body and transports the vertical gas sealed body to the rear retrieving rack.

In some embodiments, the pressing wheel is a circular shape pressing wheel, a gear shape pressing wheel, or a butterfly shape pressing wheel. The butterfly shape pressing wheel comprises a trough, and the inflating stick is in the trough. In addition, the processing machine further comprises a rolling shaft between the transport wheel and the processing platform. The rolling shaft drives the gas sealed body to move.

In some embodiments, the gas sealed body comprises a plurality of films and a plurality of heat-seal lines. The heat-seal lines seal the films to form a plurality of gas columns not inflated. The gas columns not inflated are pressed at the packing segment of the inflating stick. The gas outlets at the packing segment inflate the gas columns not inflated. The cutter cuts the heat-seal lines at a side end of the films.

In some embodiments, the gas sealed body not inflated is turned about a turning point formed by the rolling shaft and is moved towards the processing platform.

According to the design of the structure of the inflating stick, the cone structure of the front end of the inflating stick is easily inserted into the inflating channel of the gas sealed body to inflate. The rear end of the inflating stick having a larger size corresponds to films with wrinkles, which facilitates gas flow from the gas outlets to the gas columns Further, the wrinkles can become smooth so that the cutter can successfully cut the side end of the gas sealed body; therefore, the link rod won't block the side end of the gas sealed body. The gas columns being inflated can be successfully retrieved and reeled in. In addition, the pressing wheels of the processing machine drive the gas sealed body to move forward and press the side end of the gas sealed body. The issue that the gas column may shift due to contraction caused by inflation when the gas sealed body is inflated, can be improved.

DETAILED DESCRIPTION

Figure 1:
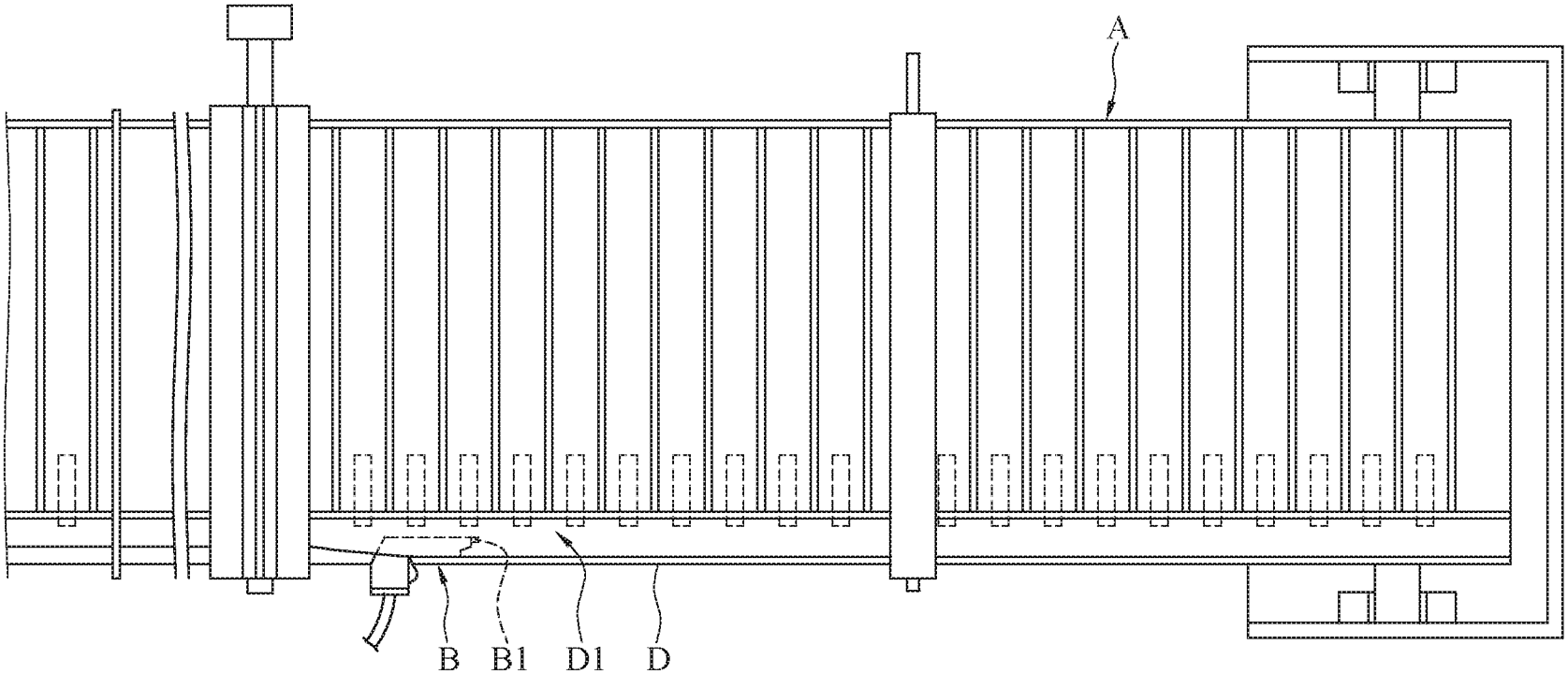
FIG.1 (PRIOR ART)
FIG. 1 illustrates a top view of continuous closed bags according to a prior art.
Figure 2:
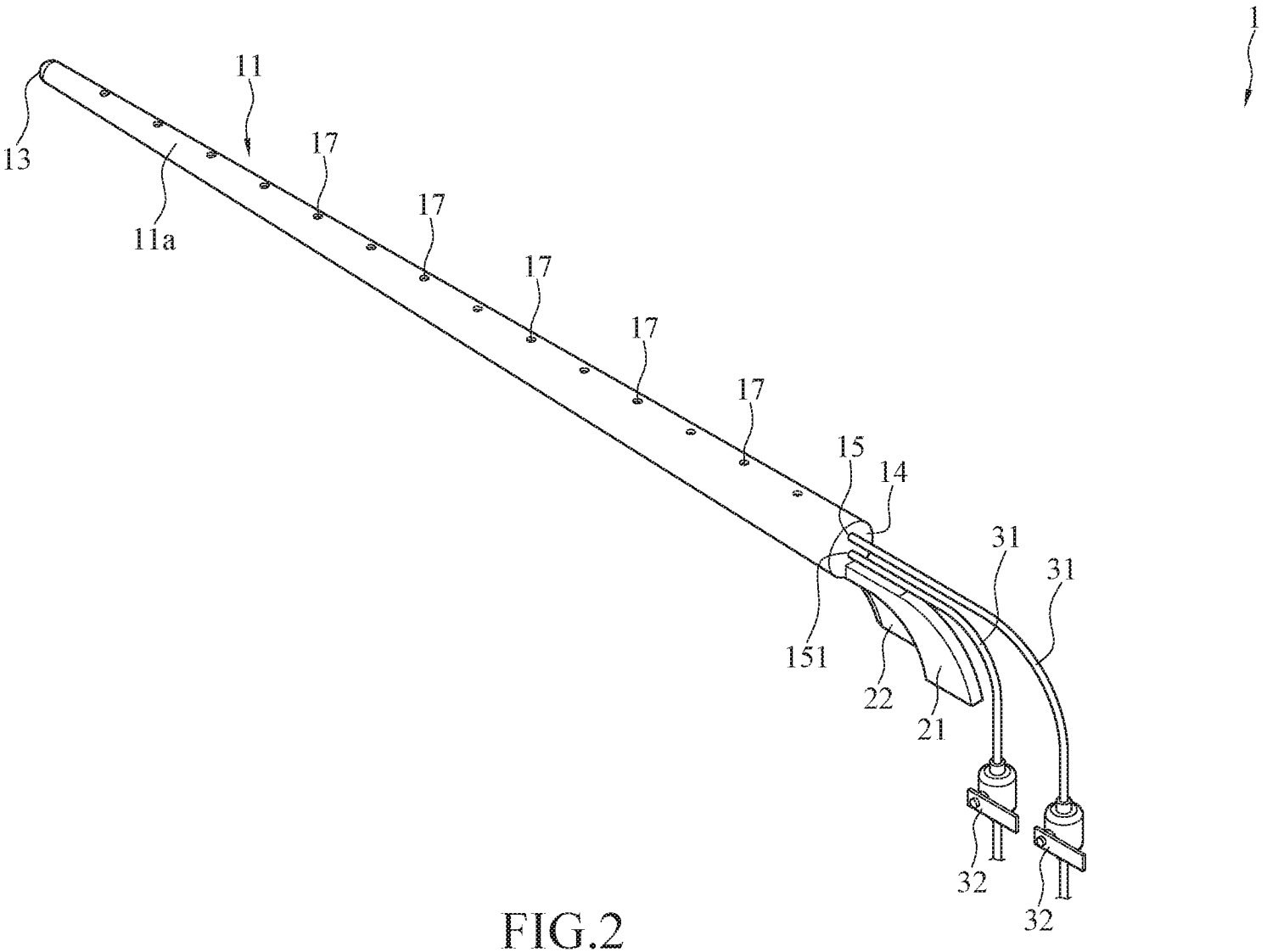
FIG. 2 illustrates a perspective view of an inflating stick according to the first embodiment of the instant disclosure.
Figure 4:
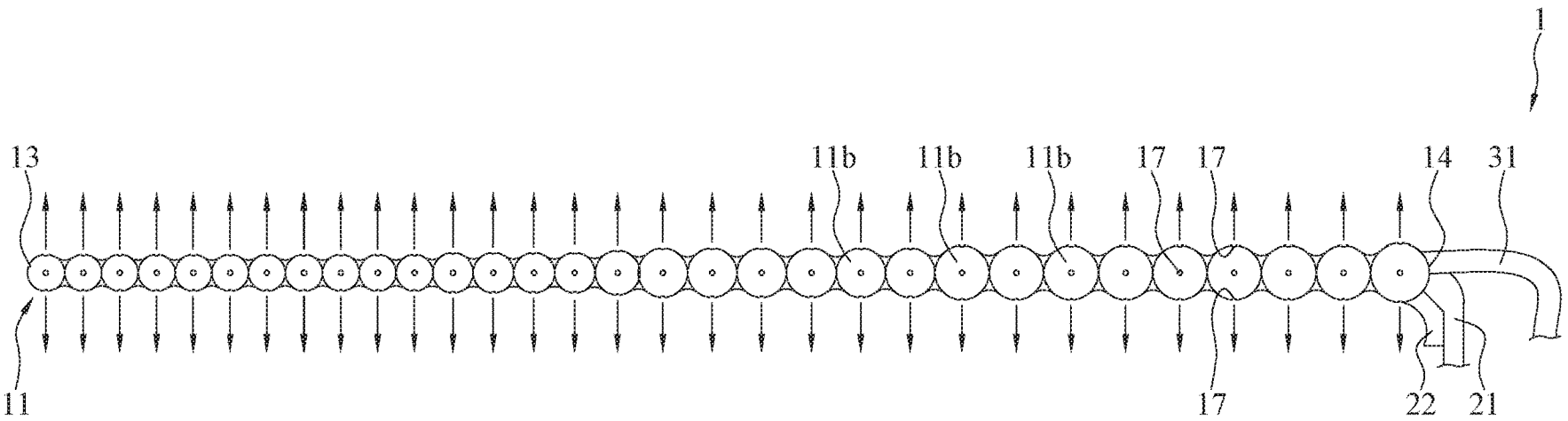
FIG. 4 illustrates a side view of an inflating stick according to the second embodiment of the instant disclosure.

Please refer to FIG. 2. FIG. 2 is a perspective view of an inflating stick 1 according to the first embodiment. In the embodiment, the inflating stick 1 is, but is not limited to, a long stick structure. In some aspects, the inflating stick 1 is made by a plurality of spheres 11*b* connected in series (as shown in FIG. 4). In the embodiment, the inflating stick 1 comprises a body 11, a link rod 21, a cutter 22, and a plurality of inflating tubes 31. Alternatively, only one inflating tube 31 in the inflating stick 1 is acceptable.

Figure 3:
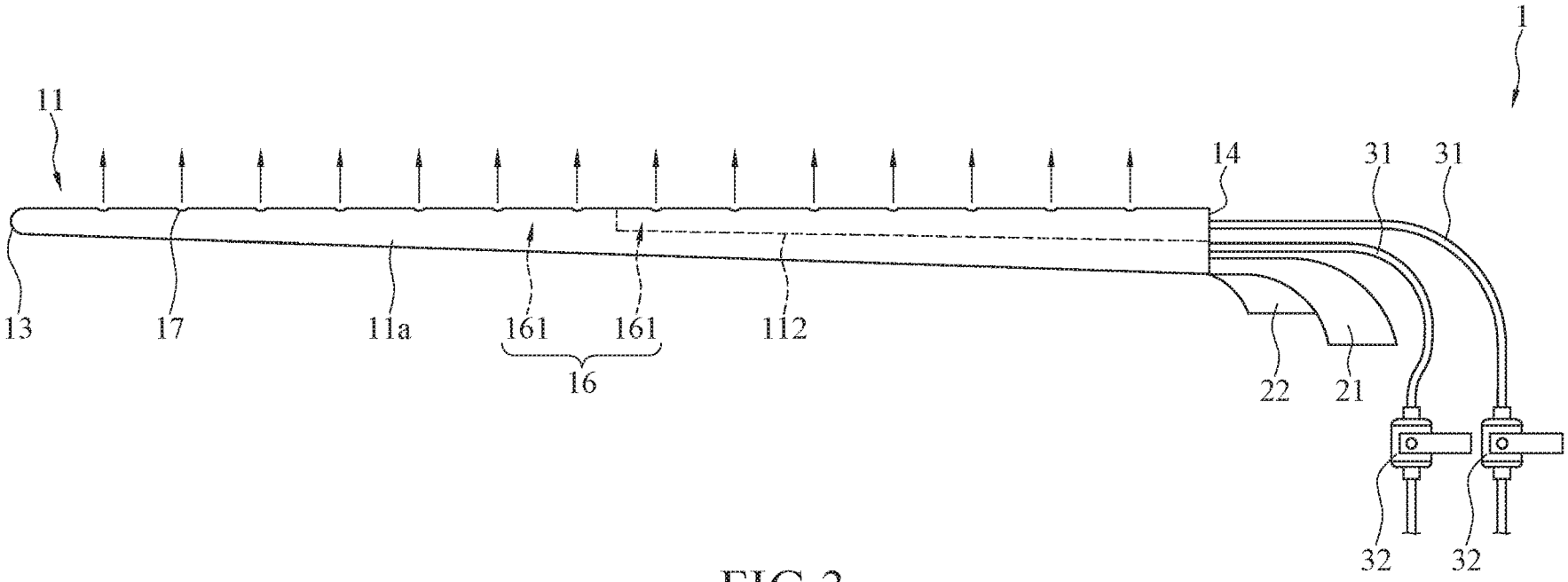
FIG. 3 illustrates a side view of the inflating stick according to the first embodiment of the instant disclosure.

Please refer to FIG. 2 and FIG. 3. FIG. 3 is a side view of the inflating stick 1 according to the first embodiment. The body 11 is a long cone 11*a*. Inside of the body 11 is hollow. The body 11 is made by metal or plastic. The size of the body 11 gradually increases from a front end to a rear end to form a guiding segment 13 and a packing segment 14. A head of the guiding segment 13 is easily inserted into an inflating channel 90 of a gas sealed body 9 due to smaller size. The body 11 comprises a gas inlet 15 formed on the packing segment 14. The body 11 further comprises an internal chamber 16 and a plurality of gas outlets 17. An internal diameter of the internal chamber 16 gradually increases due to the shape of the body 11. The internal chamber 16 allows gas to flow into through the gas inlet 15. Additionally, gas can flow out through the gas outlets 17 formed on an outer wall of the body 11. The intervals between each adjacent two of the gas outlets 17 can be identical or can be different. The gas outlet 17 can be disposed on any position on the outer wall of the body 11. Bore diameters of each of the gas outlets 17 can, but not limited to, gradually increase corresponding to the size of the long cone 11*a*. In the embodiment, the bore diameters of each of the gas outlets 17 are 2.5 mm or 3.2 mm The intervals between the centers of each adjacent two of the gas outlets 17 are substantially 8 mm.

Figure 13:
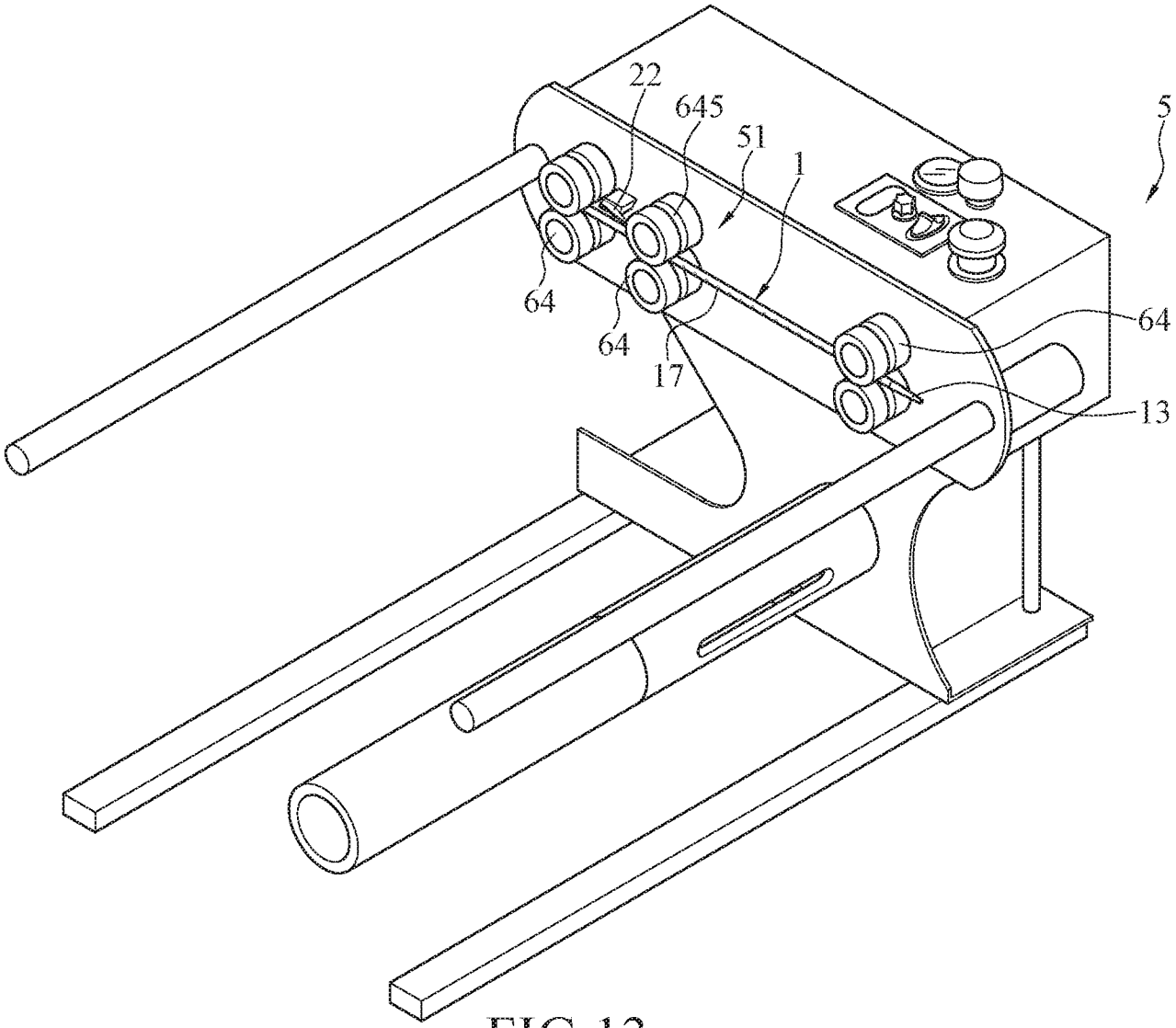
FIG. 13 illustrates a perspective view of a processing machine according to the third embodiment of the instant disclosure.
Figure 14:
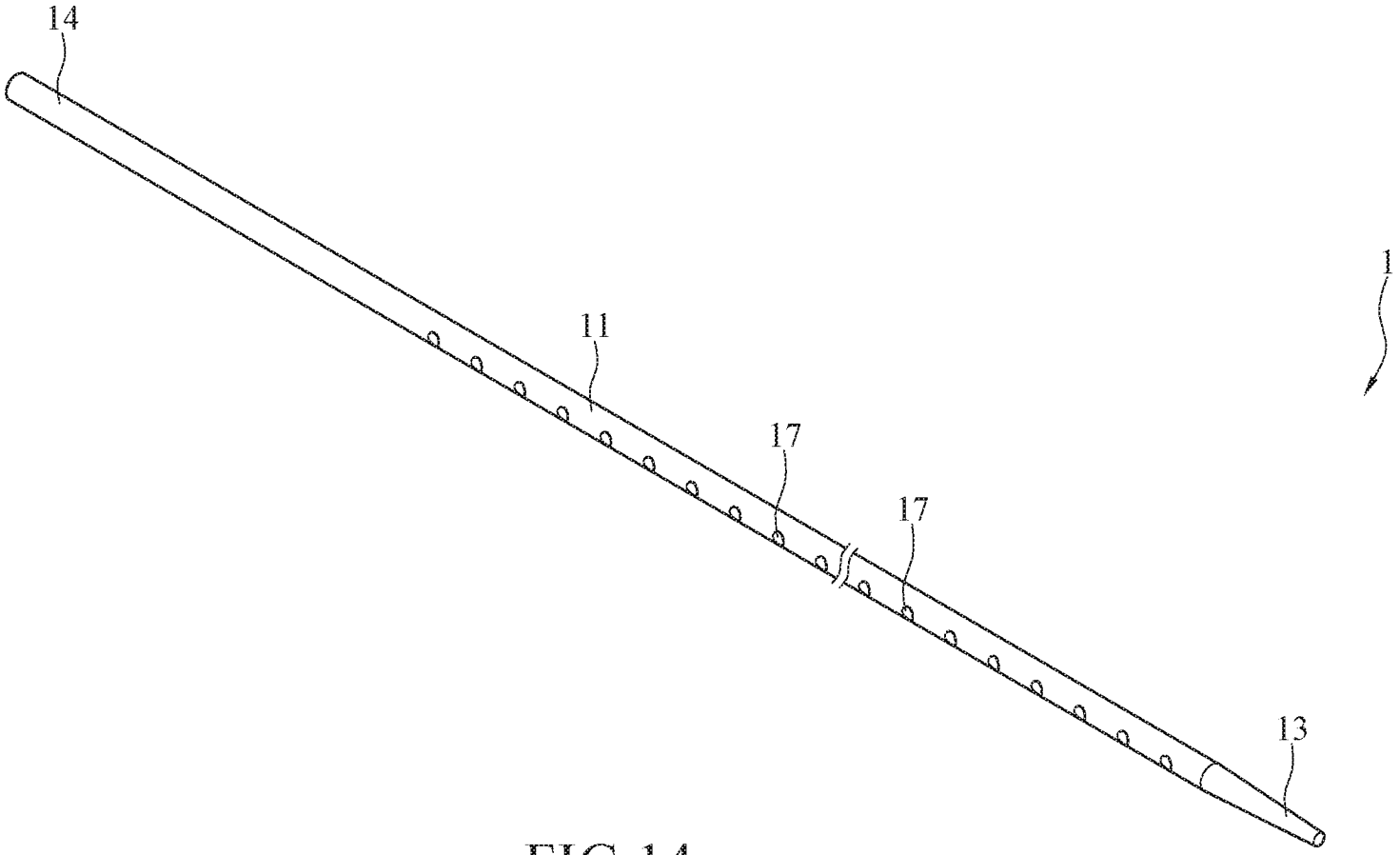
FIG. 14 illustrates a perspective view of an inflating stick according to another aspect of the instant disclosure.

The whole inflating stick 1 having a cone structure is the first aspect. Some other aspects of the inflating stick 1 can be referred to FIG. 13 and FIG. 14. FIG. 13 is a perspective view of a processing machine according to the third embodiment. FIG. 14 is a perspective view of an inflating stick 1 according to another aspect. In the embodiment, the inflating stick 1 is the second aspect. The guiding segment 13 of the body 11 of the inflating stick 1 is designed to form the cone structure. The guiding segment 13 with the cone structure extends outside of two pressing wheels 64, which are an upper pressing wheel 64 and a lower pressing wheel 64, to be easily inserted into an inflating channel 90 of a gas sealed body 9. The guiding segment 13 of the inflating stick 1 is a cone structure (a cone); however, a middle part of the body 11 to the rear end of the body 11 is a tube, which is a tube structure having an identical diameter. In other words, the whole inflating stick 1 is a cone at the front and a tube at the rear (being sharp at the front and being straight at the rear). An external diameter of the packing segment 14 of the rear end of body 11 is greater than that of the guiding segment 13 of the front end.

Figure 5:
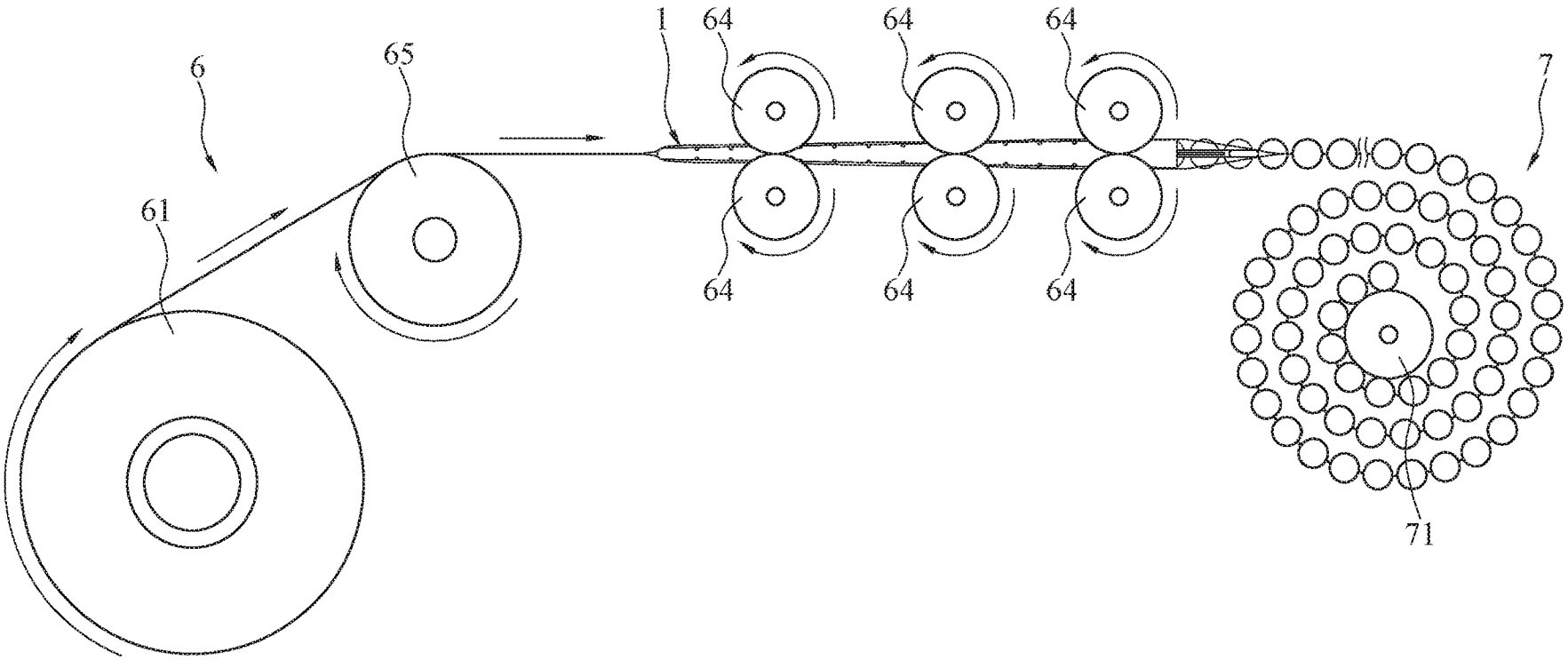
FIG. 5 illustrates a side view of a processing machine according to the first embodiment of the instant disclosure.
Figure 6:
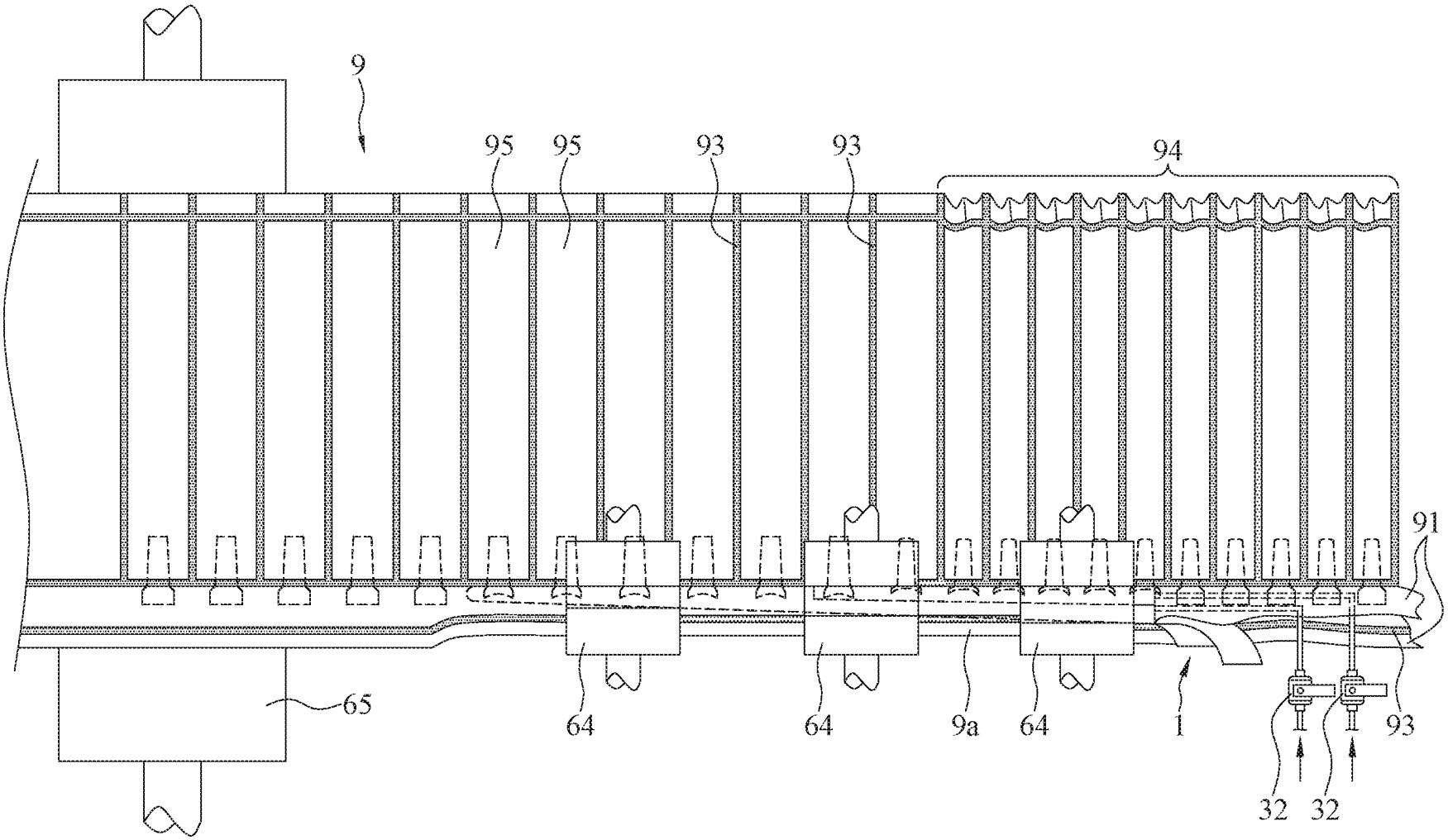
FIG. 6 illustrates a top view of the processing machine according to the first embodiment of the instant disclosure.
Figure 11:
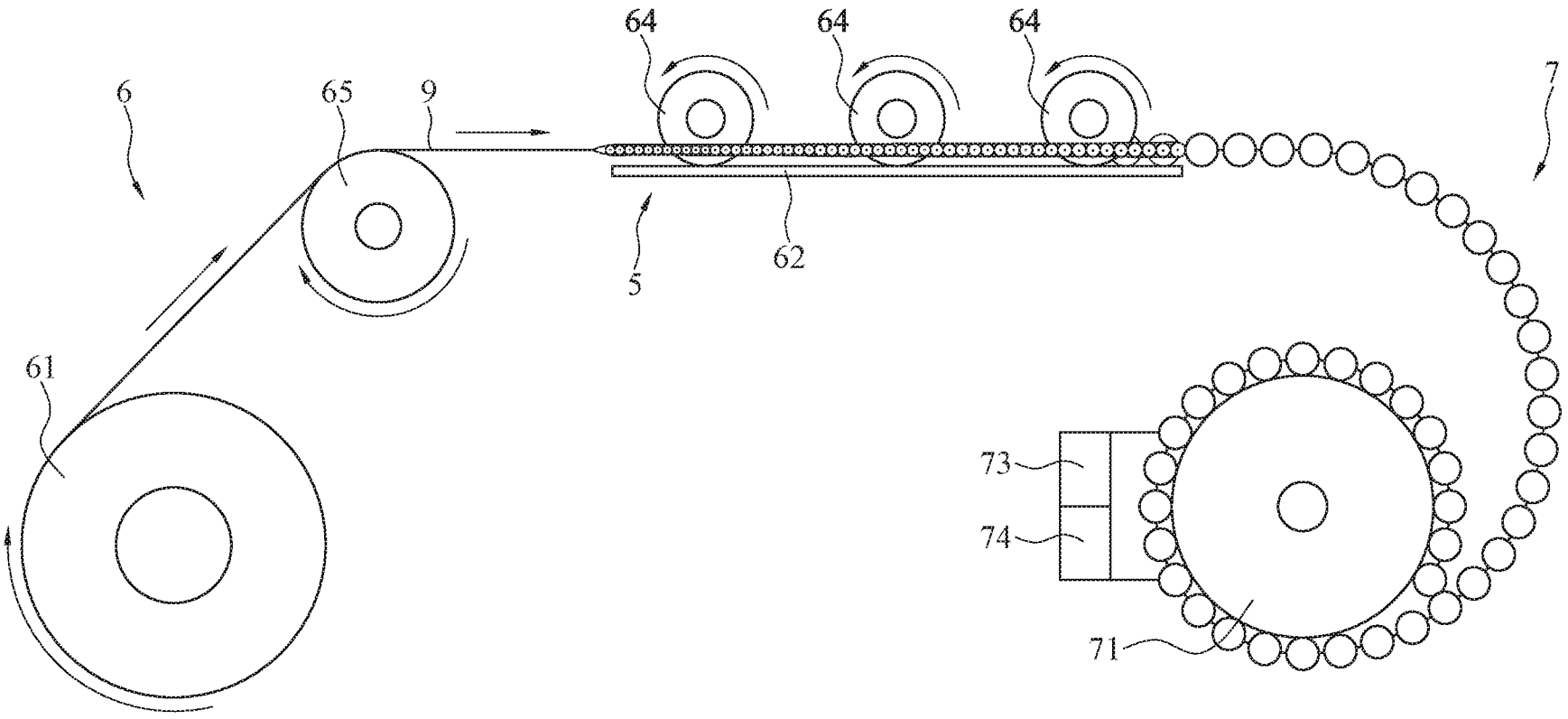
FIG. 11 illustrates a side view of a processing machine according to the second embodiment of the instant disclosure.

Please refer to FIGS. 2, 5, 6, and 11. FIG. 5 is a side view of a processing machine according to the first embodiment. FIG. 6 is a top view of the processing machine according to the first embodiment. FIG. 11 is a side view of a processing machine according to the second embodiment. In the embodiment, the link rod 21 extends outwardly from the rear end of the body 11. The link rod 21 can be connected to a processing platform 62. The cutter 22 is disposed in rear of the body 11 and between the packing segment 14 and the link rod 21. When the gas sealed body 9 passes the packing segment 14 and continuously moves forward, a side end 9*a* of the gas sealed body 9 is cut by the cutter 22 such that the gas sealed body 9 can successfully move forward. The issue that the gas sealed body 9 is blocked by the link rod 21 and thus incapable of moving forward, can be avoided.

In addition, the side end 9*a* of the gas sealed body 9 encloses the inflating stick 1 during the inflating process. The two pressing wheels 64 (the upper one and lower one), press the side end 9*a* of the gas sealed body 9 and stably drive the gas sealed body 9 to move forward. After each of gas columns 95 of the gas sealed body 9 is inflated, the side end 9*a* of the gas sealed body 9 is cut by the cutter 22. Then, the side end 9*a* of the gas sealed body 9 is opened and detached from the inflating stick 1. In other words, the side end 9*a* of the gas sealed body 9 sealed at a heat-seal portion is cut to be open by the cutter 22.

Please refer to FIGS. 2, 3, and 6. The inflating tubes 31 are connected to the gas inlet 15 of the packing segment 14. The inflating tubes 31 are for supplying gas to the internal chamber 16. In the embodiment, two inflating tubes 31 are connected to the gas inlet 15. Specifically, the body 11 further comprises a dividing block 112. The dividing block 112 is disposed in the internal chamber 16 such that the internal chamber 16 is divided into two corresponding inflating sections 161. Alternatively, the body 11 can comprise a plurality of dividing blocks 112 and the internal chamber 16 is divided into three or more corresponding inflating sections 161. An outside end of the dividing block 112 is at the gas inlet 15 to form two openings 151. The two openings 151 are respectively connected to the two inflating tubes 31. The inflating stick 1 further comprises switch valves 32. Each of the switch valves 32 is individually disposed on each of the inflating tubes 31. The switch valves 32 can be turned on or off to enable or disable an inflating process of gas. As needed, all of the switch valves 32 can be turned on in the same time to inflating, or part of the switch valves 32 can be turned on to inflating. When the gas columns 95 on the gas sealed body 9 have different sizes, the gas columns 95 with different sizes may require different inflating durations to be inflated. According to the sizes of the gas columns 95, the switch valves 32 can be utilized to control the inflating durations of the larger gas columns 95 and the smaller gas columns 95. In the embodiment, the aspect that the two inflating tubes 31 are connected to the body 11 is merely an example. In some aspects, one inflating tube 31 connected to the body 11 is acceptable.

Please refer to FIG. 4, which is the second embodiment of the inflating stick 1. FIG. 4 is a side view of the inflating stick 1 according to the second embodiment. Differences between the second embodiment and the first embodiment are as follows. The body 11 is made by a plurality of spheres 11*b* connected in series. Each of the spheres 11*b* is hollow. Bore diameters of the internal chambers 16 of each the spheres 11*b* gradually increase due to the shape of the spheres 11*b*. Additionally, the guiding segment 13 is at the smaller spheres 11*b*, and the packing segment 14 is at the larger spheres 11*b*. One inflating tube 31 is connected to the last larger sphere 11*b*. When the inflating tube 31 inflates gas into the spheres 11*b*, the gas flows from the larger spheres 11*b* to the smaller spheres 11*b* and flows out from the gas outlets 17 of the outer walls of the spheres 11*b*. The intervals between each adjacent two of the gas outlets 17 can be identical or can be different. Each of the gas outlets 17 can be disposed on any position on the outer wall of the body 11. Alternatively, the gas outlets 17 can be formed on three points perpendicular to one another on the outer wall of each of the spheres 11*b*. The bore diameters of each of the gas outlets 17 can, but not limited to, gradually increase corresponding to the sizes of the spheres 11*b*. Alternatively, the bore diameters of each of the gas outlets 17 can be identical.

Figure 12:
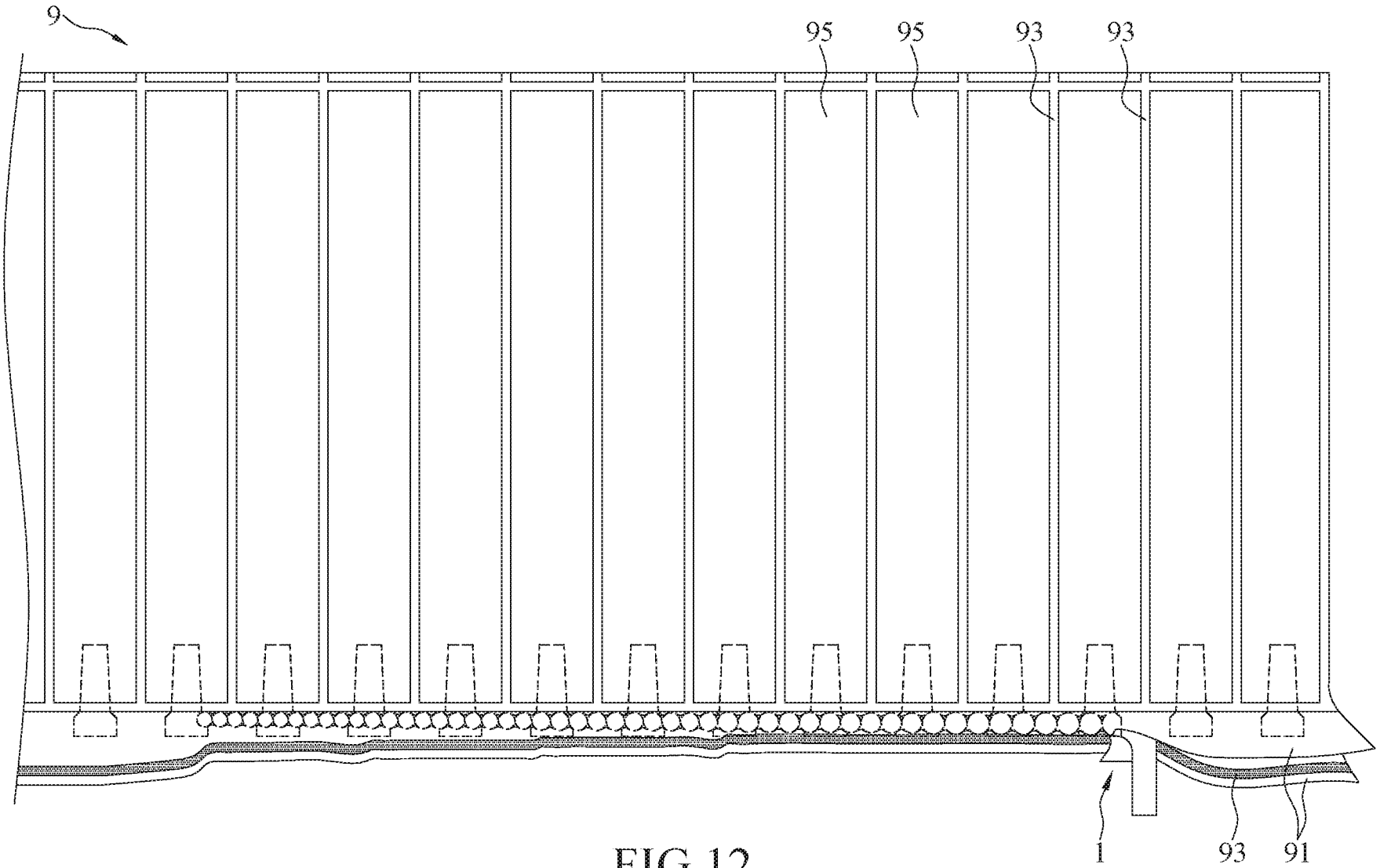
FIG. 12 illustrates a top view of the processing machine according to the second embodiment of the instant disclosure.

Please refer to FIGS. 4, 11, and 12. FIG. 12 is a top view of the processing machine according to the second embodiment. In the embodiment, a cross section of the sphere 11*b* can form a substantially concave-convex shape, and a cross section corresponding to the gas columns 95 of the gas sealed body 9 can form a substantially concave-convex shape. The outer wall of the spheres 11*b* has a plurality of gas outlets 17. After the spheres 11*b* are inserted into the inflating channel 90 of the gas sealed body 9 and inflating, the inflated gas columns 95 are expanded. A cross section of each of the inflated gas columns 95 is a substantially sphere shape. A cross section of each of the gas columns 95 not inflated remains a flat shape Films 91 of the gas columns 95 not inflated are easily wrinkled by each other because the films 91 are not spread. In other words, the contraction of each of the films 91 leads to the formation of a wrinkle area 94 (as shown in FIG. 6). The gas columns 95 not inflated are packed together and overlapped each other, and consequently the cutter 22 in front of the link rod 21 cannot accurately cut the side end 9*a* of the gas sealed body 9. A direction towards which the gas sealed body 9 move during the process is blocked. That is to say, the gas sealed body 9 is blocked on the processing platform 62.

Please refer to FIGS. 4, 11, and 12. According to the design of inflating stick 1 with the smaller spheres 11*b* connected with the larger spheres 11*b*, the gas columns 95 11*b* which are being inflated are getting close to each other and packed together and form spheres, and the pressure between the spheres of the gas columns 95 is benefit to gas flowing from the gas outlets 17 of each of the larger spheres 11*b* into the gas columns 95 such that the films 91 in the wrinkle area 94 can become flat and smooth. As a result, the cutter 22 can successfully cut the side end 9*a* of the gas sealed body 9, and the link rod 21 does not block the side end 9*a* of the gas sealed body 9. The gas columns 95 being inflated can successfully move forward and be retrieved and reeled in.

Please refer to FIGS. 5, 6, 11, and 12. FIGS. 5 and 6 illustrate a processing machine according to the first embodiment. The inflating stick 1 of FIGS. 5 and 6 adopts the design of the long cone 11*a*. FIGS. 11 and 12 illustrate a processing machine according to the second embodiment. The inflating stick 1 of FIGS. 11 and 12 adopts the design of the spheres 11*b*. FIG. 5 is a side view. FIG. 6 is a top view. FIG. 11 is a side view. FIG. 12 is a top view. The processing machine 5 of the embodiment can adopt one of the inflating stick 1 of the aforementioned two embodiments. In the embodiment, the processing machine 5 comprises a front platform 6, the aforementioned inflating stick 1, and a rear retrieving rack 7.

Figure 7:
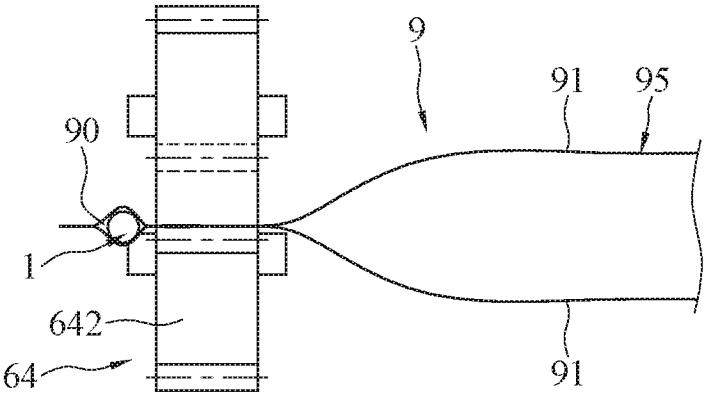
FIG. 7 illustrates a partially enlarged view of a gear type pressing wheel and a gas sealed body according to the instant disclosure.

Please refer to FIGS. 5 and 11. In the embodiment, the front platform 6 comprises a transport wheel 61 and the processing platform 62. The transport wheel 61 transports the gas sealed body 9 not inflated to the processing platform 62. The link rod 21 of the inflating stick 1 is fixed to the processing platform 62. The processing platform 62 is a flat platform. Each of the gas columns 95 not inflated can be spread over the processing platform 62 to be processed. The guiding segment 13 of the body 11 is inserted into the inflating channel 90 of the gas sealed body 9 to inflate (as shown in FIG. 7). The gas sealed body 9 continuously moves forward to the rear retrieving rack 7. The rear retrieving rack 7 comprises a retrieving wheel 71. The retrieving wheel 71 retrieves and reels in the inflated gas sealed body 9. The gas sealed body 9 can be continuously retrieved and reeled in by the retrieving wheel 71. In addition, the processing machine 5 can further comprise a rolling shaft 65. The rolling shaft 65 is between the transport wheel 61 and the processing platform 62. The rolling shaft 65 drives the gas sealed body 9 to move forward. Additionally, the rolling shaft 65 can decrease the resistance to facilitate the movement of the gas sealed body 9.

Please refer to FIGS. 5 and 6. In the embodiment, the processing machine 5 further comprises the pressing wheels 64. The pressing wheels 64 are next to the inflating stick 1. Each of the pressing wheels 64 individually presses an upper side and a lower side of the gas sealed body 9 and transports the gas sealed body 9 to the rear retrieving rack 7. The pressing wheels 64 drive the gas sealed body 9 to move forward and meanwhile press the side end 9*a* of the gas sealed body 9; therefore, the issue that the gas columns 95 shift due to contraction caused by inflation when the gas sealed body 9 is inflated can be solved. Additionally, the design that the gas sealed body 9 is pressed by the pressing wheels 64 can prevent the gas in the gas columns 95 from leaking off.

Figure 15:
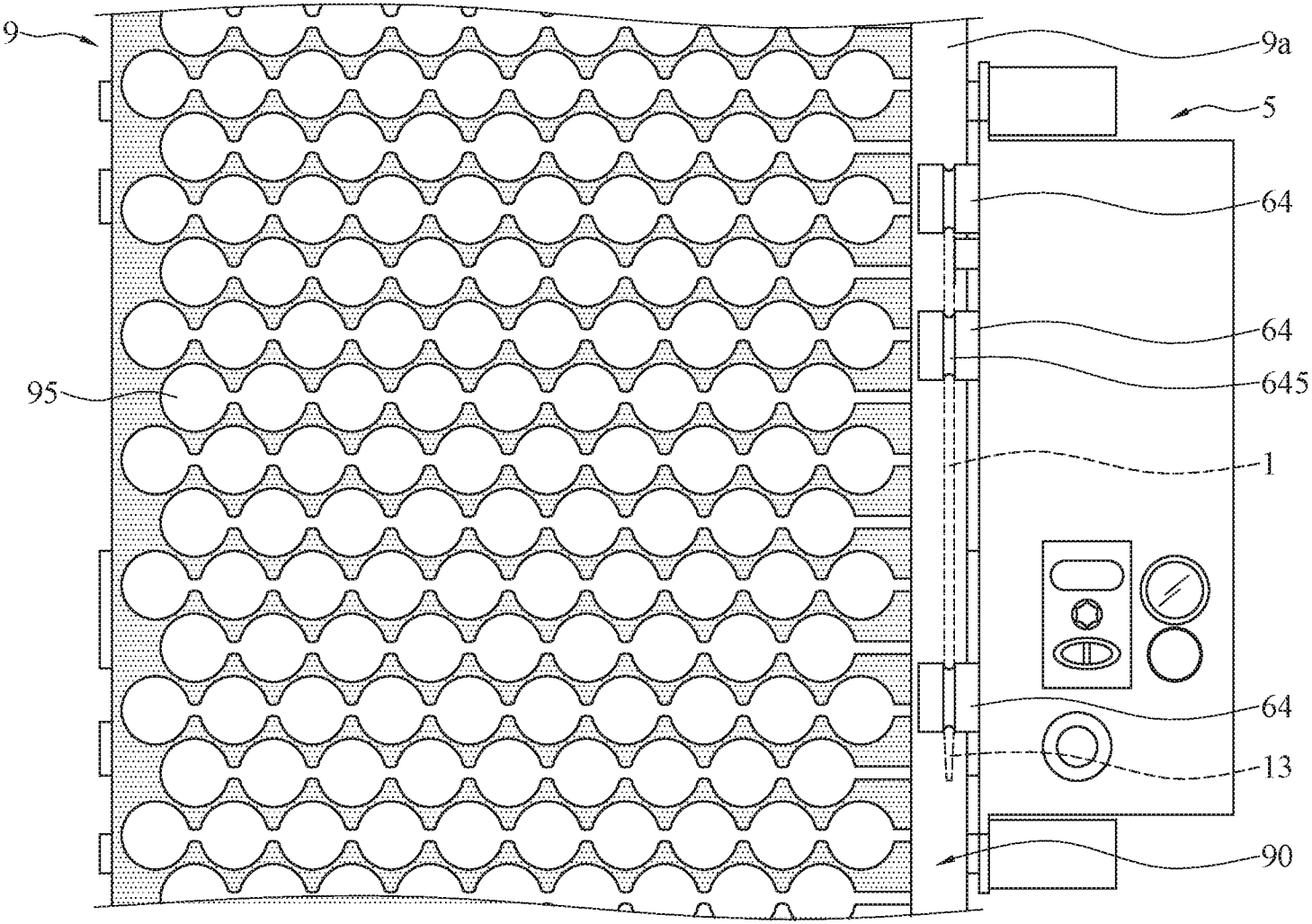
FIG. 15 illustrates a top view of pressing wheels pressing a horizontal gas sealed body according to the instant disclosure.

Please refer to FIGS. 13 and 15. FIG. 15 is a top view of the pressing wheels pressing a horizontal gas sealed body. In some aspects, Three sets of pressing wheels 64 (two of the adjacent pressing wheels 64 is a set) are adopted. The first set of the pressing wheels 64 is positioned next to the guiding segment 13 of the inflating stick 1. The second set and the third set of the pressing wheels 64 are next to each other and are positioned at the packing segment 14 of the inflating stick 1. The cutter 22 is between the second set and the third set of the pressing wheels 64. The design that the gas sealed body 9 is, but is not limited to, pressed by the three sets of the pressing wheels 64 can prevent the gas in the gas columns 95 from leaking off. In some aspects, one set of the pressing wheels 64 or two sets of the pressing wheels 64 can be adopted.

Please refer to FIGS. 13 and 15. In the first aspect, the pressing wheels 64 press the upper side and the lower side of the side end 9*a* of the gas sealed body 9, and the pressing wheels 64 are respectively installed at an upper side and a lower side of a working area 51 of the processing machine 5. The gas sealed body 9 is, but is not limited to, horizontally transported and inflated while the side end 9*a* is horizontally disposed between each set of the pressing wheels 64.

Figure 16:
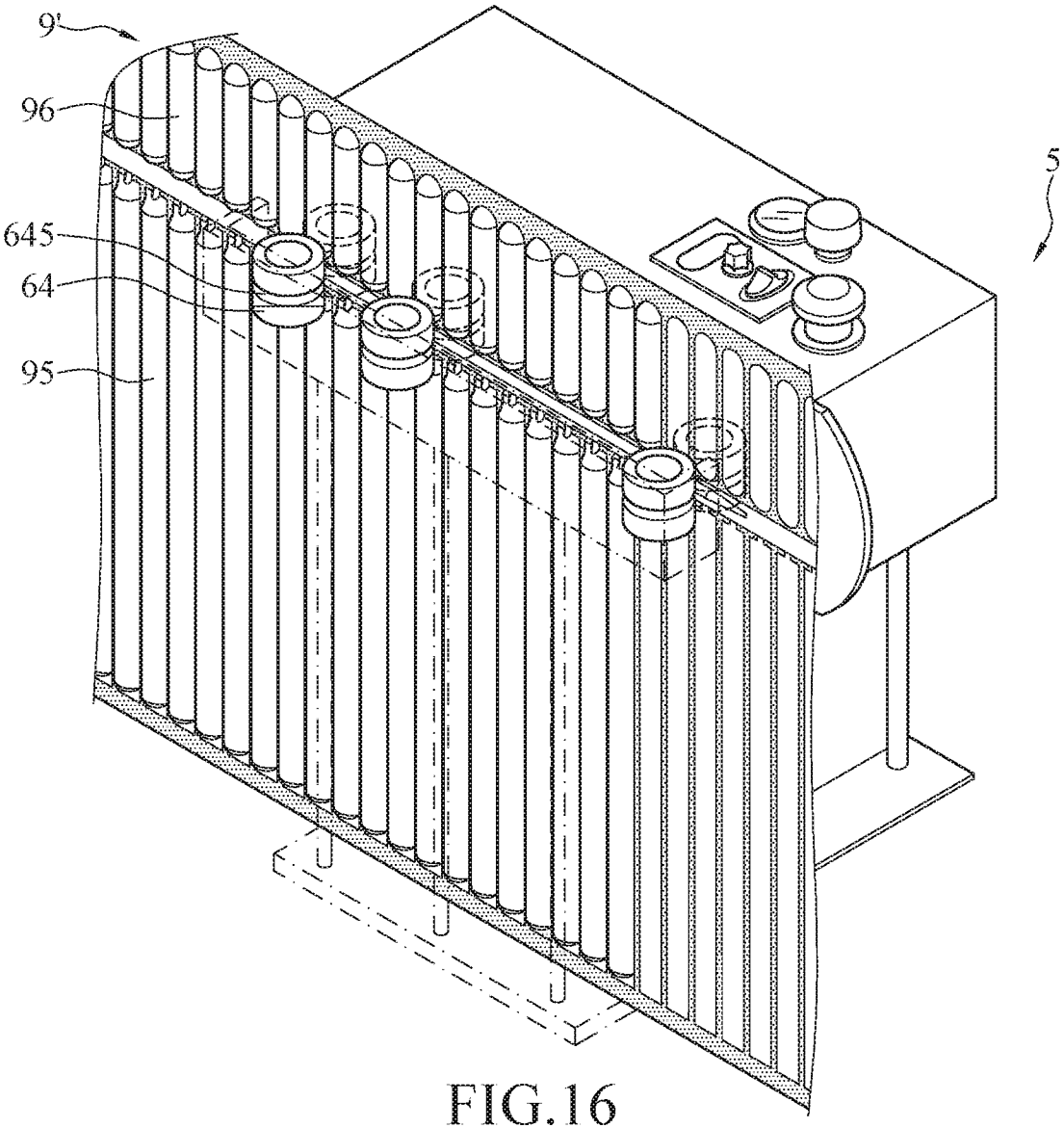
FIG. 16 illustrates a perspective view of pressing wheels according to another aspect of the instant disclosure.
Figure 17:
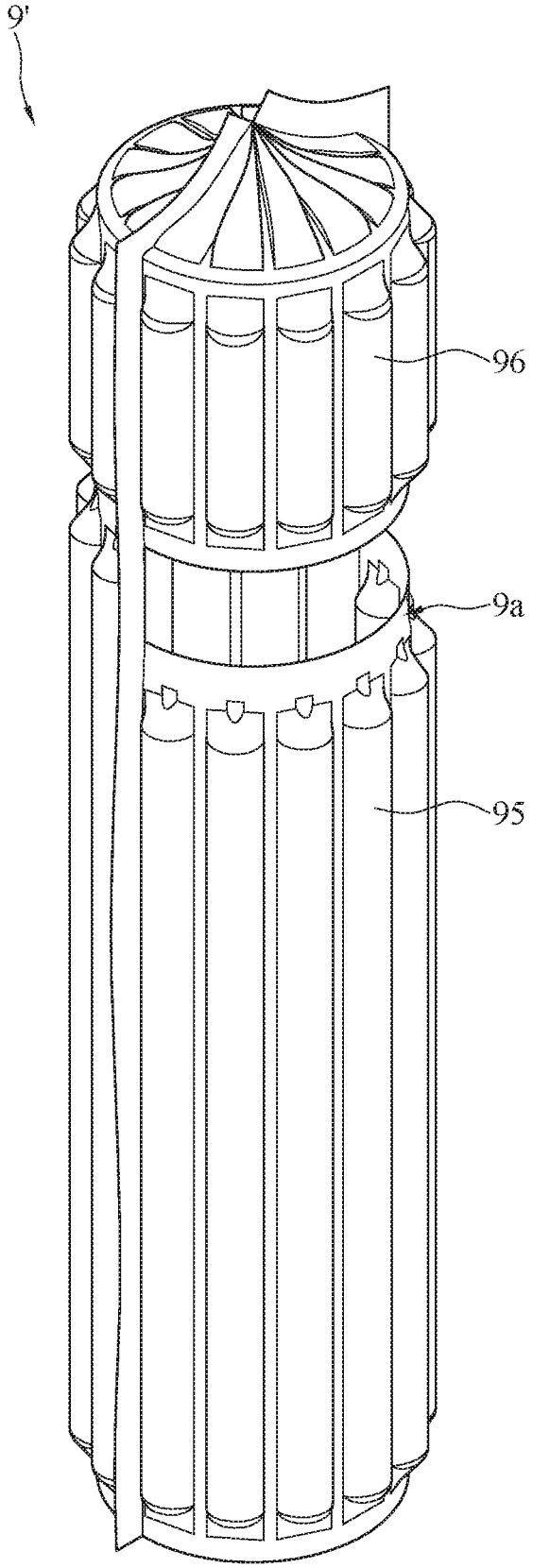
FIG. 17 illustrates a perspective view of a vertical gas sealed body according to the instant disclosure.

Some other aspects are as follows. Please refer to FIGS. 16 and 17. FIG. 16 is a perspective view of the pressing wheels 64 according to another aspect. FIG. 17 is a perspective view of a vertical gas sealed body. The pressing wheels 64 shown in FIGS. 16 and 17 are the second aspect. In the aspect, the pressing wheels 64 are respectively installed at a front side and a rear side of a working area of the processing machine 5, i.e., the elements of the first aspect including the pressing wheels 64, the cutter 22, and the inflating stick 1 rotate to 90 degrees. The gas sealed body 9' is vertically transported and inflated while the side end 9*a* is vertically disposed between each set of the pressing wheels 64.

The processing machine 5 is adapted to inflate and shape the gas sealed body 9' with different shapes, e.g., horizontal inflatable package bags (as shown in FIG. 15), or vertical inflatable package bags (as shown in FIG. 16). It is noted that the pressing wheels 64 are at a front side and a rear side of the gas sealed body 9' to have the gas sealed body 9' transported and inflated, which avoids issues that a head structure 96 of the vertical gas sealed body 9' blocks the processing machine 5 such that the gas sealed body 9' cannot be transported. When the above issue occurs, the final products of the gas sealed bodies 9' manufactured by the processing machine 5 may not be identical. The inflatable package bags shown in FIG. 17 are inflated and form a cylinder shape.

In some aspects, the inflating stick 1, the pressing wheel 64, the link rod 21, and the inflating tube 31 can move along a sliding base (not shown). The adjacent pressing wheels 64 are mated with a bearing shaft capable of pressing and with an extending base being built-in. When a middle part of the gas sealed body 9 needs to be inflated, additional upside and downside inflating mechanics can be adopted as an auxiliary manner to inflating.

Please refer to FIGS. 5, 6, and 7. The gas sealed body 9 comprises a plurality of films 91 and a plurality of heat-seal lines on the films 91 capable of sealing the films 91 by heat. The heat-seal lines 93 seal the films 91 to form an area having the gas columns 95. The gas columns 95 not inflated are pressed at the packing segment 14 of the inflating stick 1. The gas outlets 17 at the packing segment 14 inflate the gas columns 95 not inflated. The cutter 22 cuts the heat-seal lines 93 at a side end 9*a* of the films 91 so that the gas sealed body 9 can continuously move forward to the rear retrieving rack 7.

Figure 8:
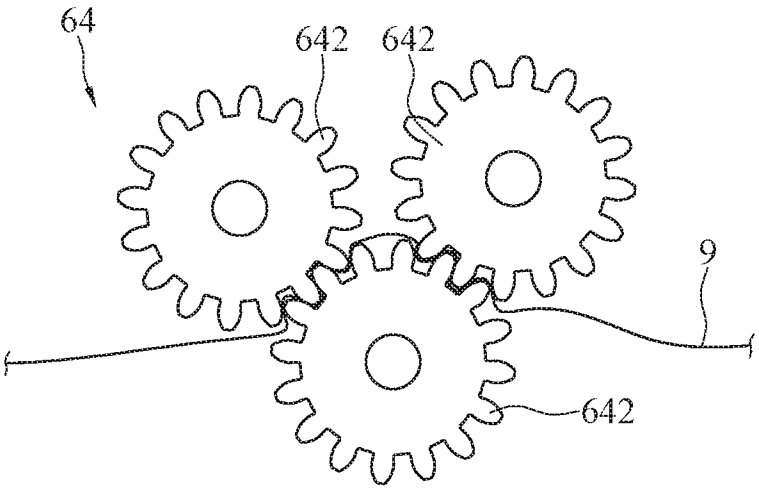
FIG. 8 illustrates a front view of the gear type pressing wheel and the gas sealed body according to the instant disclosure.
Figure 9:
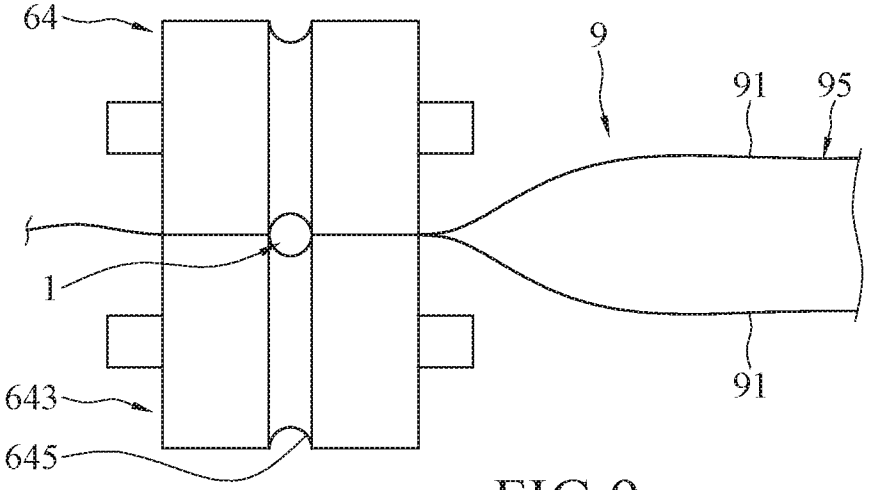
FIG. 9 illustrates a partially enlarged view of a butterfly type pressing wheel and a gas sealed body according to the instant disclosure.
Figure 10:
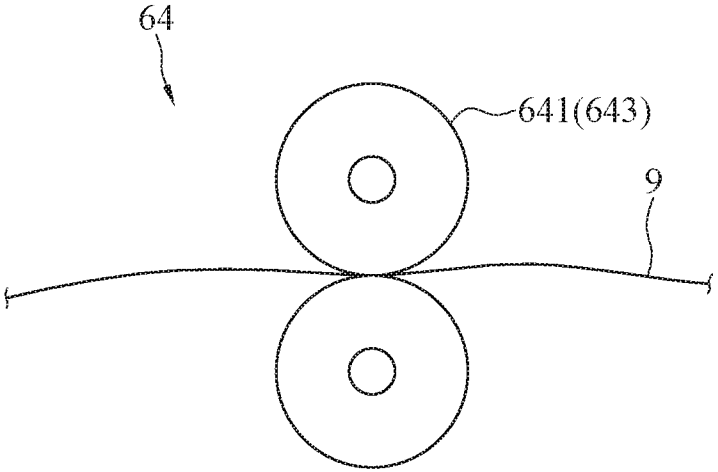
FIG. 10 illustrates a front view of a circular type/butterfly type pressing wheel and the gas sealed body according to the instant disclosure.

Please refer to FIGS. 7, 8, 9, and 10. FIG. 7 is a partially enlarged view of a gear type pressing wheel and a gas sealed body. FIG. 8 is a front view of the gear type pressing wheel and the gas sealed body. FIG. 9 is a partially enlarged view of a butterfly type pressing wheel and a gas sealed body. FIG. 10 is a front view of a circular type/butterfly type pressing wheel and the gas sealed body. In the embodiment, the pressing wheel 64 can be a circular shape pressing wheel 641 or a gear shape pressing wheel 642. The circular shape pressing wheel 641 can be two circular wheels, which include an upper wheel and a lower wheel contact each other. Alternatively, the circular shape pressing wheel 641 can be a butterfly shape pressing wheel 643. The gear shape pressing wheel 642 can include three wheels arranged as one upper wheel and two lower wheels engaged one another or as two upper wheels and one lower wheel engaged one another. Further, the gas sealed body 9 is between the upper wheel(s) and the lower wheel(s). The pressing wheels 64 can press and drive the gas sealed body 9 to continuously move forward. The butterfly shape pressing wheel 643 comprises a trough 645 on an outer surface of the wheel. In a cross section of the butterfly shape pressing wheel 643, the center of the butterfly shape pressing wheel 643 is concaved to form the annular trough 645. The inflating stick 1 is limited in the trough 645.

Please refer to FIG. 11. The rear retrieving rack 7 further comprises a tension controller 73 and a calculator 74. The tension controller 73 controls a tightness of the inflated gas sealed body 9 being retrieved and reeled in. The calculator 74 controls a length of the inflated gas sealed body 9 being retrieved and reeled in.

Figure 18:
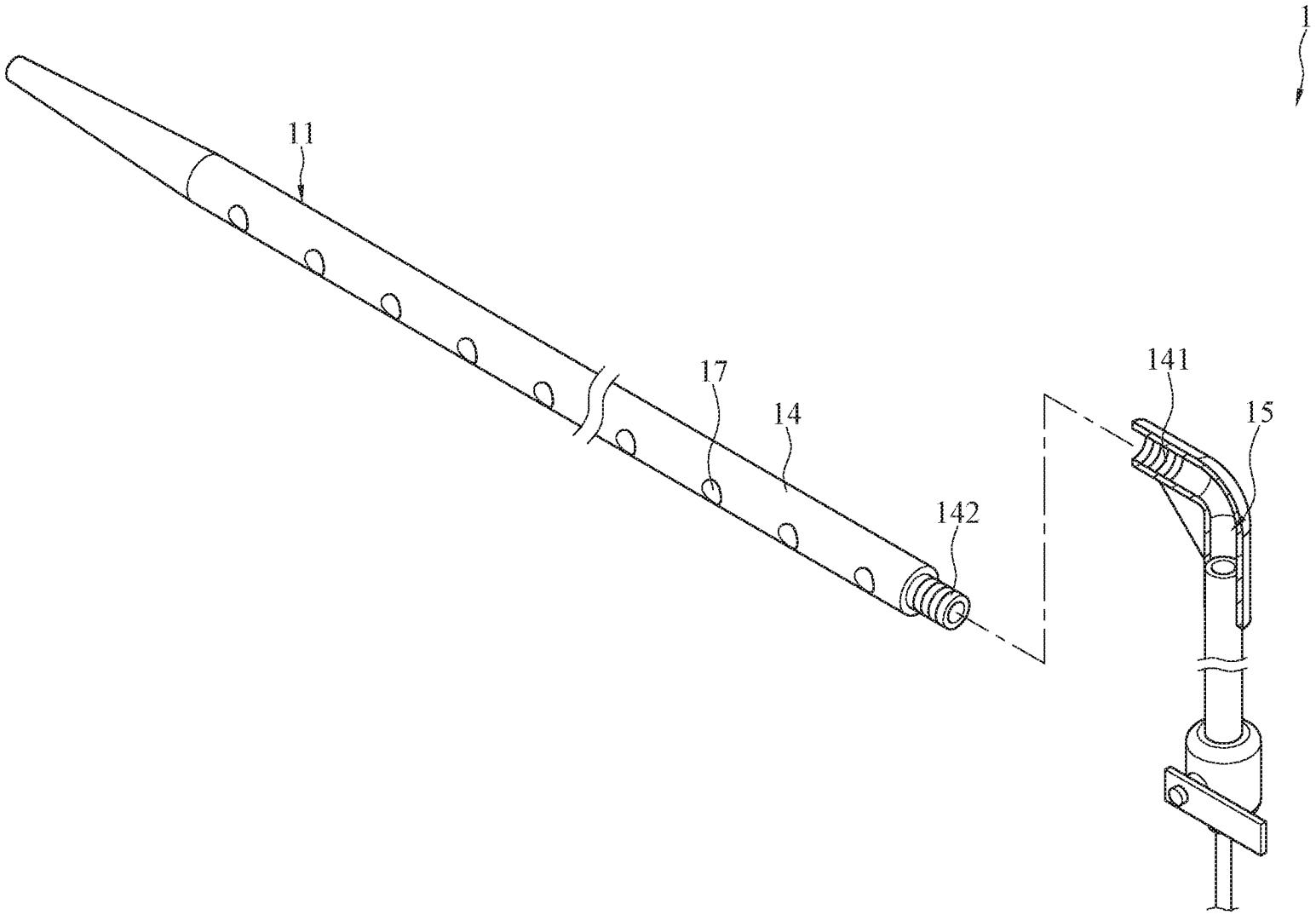
FIG. 18 illustrates a perspective view of an inflating stick according to another aspect of the instant disclosure.

Please refer to FIG. 18, which is a perspective view of the inflating stick 1 according to another aspect. In the embodiment, the packing segment 14 of the inflating stick 1 further comprises a first locking structure 141 and a second locking structure 142. The second locking structure 142 is detachably fastened to the first locking structure 141. In the embodiment, the first locking structure 141 is adjacent to the gas inlet 15. The first locking structure 141 comprises a female thread, and the second locking structure 142 comprises a male thread with a hollow-tube structure. Based upon these structures, the body 11 of the inflating stick 1 can be changed to correspond to varied sizes of the gas sealed body 9 not inflated.

In another embodiment, the first locking structure 141 comprises a male thread with a hollow-tube structure, and the second locking structure 142 comprises a female thread. In some embodiments, the first locking structure 141 and the second locking structure 142 can be fastened in a buckling manner.

Figure 19:
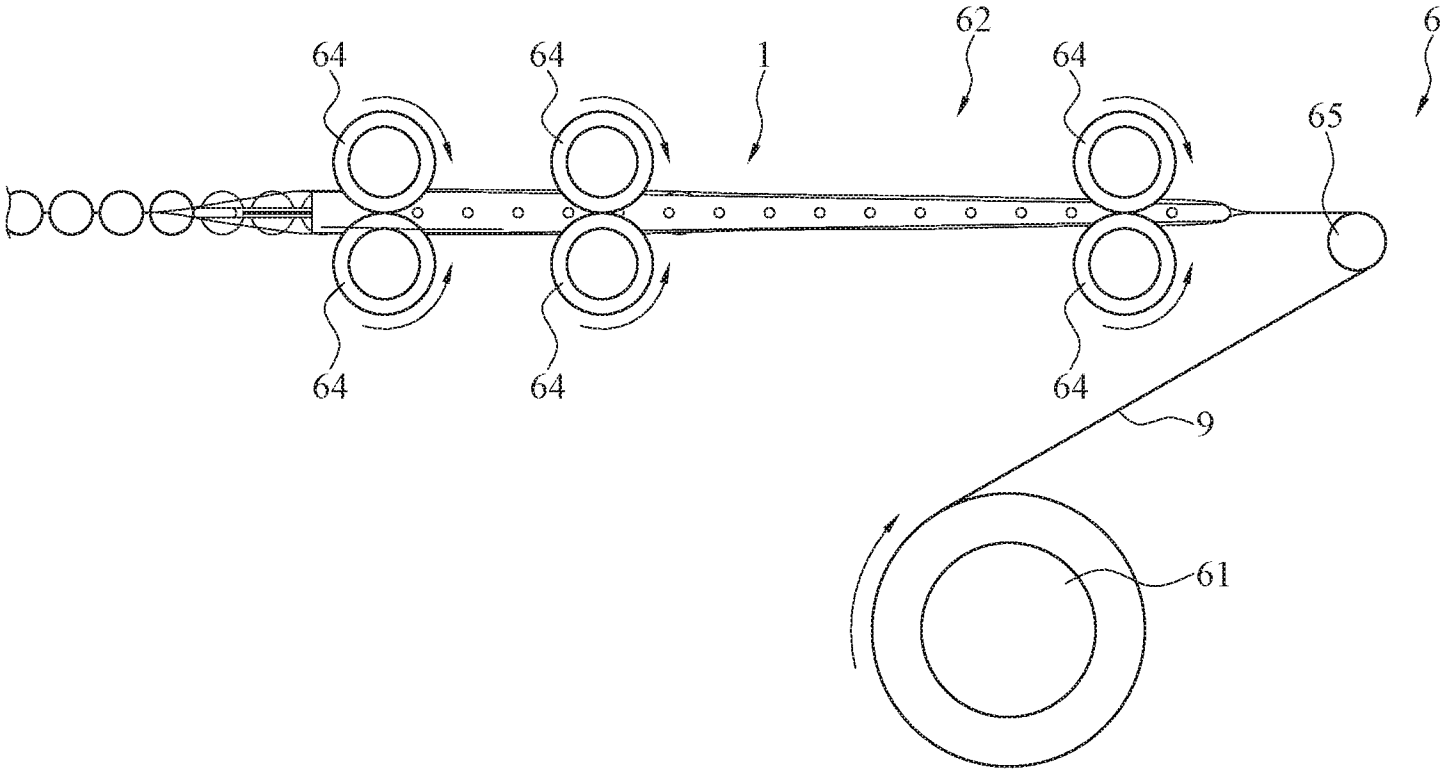
FIG. 19 illustrates a side view of a processing machine according to the fourth embodiment of the instant disclosure.

Please refer to FIG. 19, which is a side view of a processing machine according to the fourth embodiment of the instant disclosure. The rolling shaft 65 of the processing machine 5 is between the transport wheel 61 and the processing platform 62. During the transportation of the gas sealed body 9 not inflated, the gas sealed body 9 not inflated is turned about a turning point formed by the rolling shaft 65 and is moved towards the processing platform 62, such that gas can be prevented from entering the gas sealed body 9 not inflated between the rolling shaft 65 and the transport wheel 61 when the inflating stick 1 inflates, otherwise the whole of the gas sealed body 9 not inflated may deviate from a rail of the transportation due to the reverse flow of gas.

Figure 20:
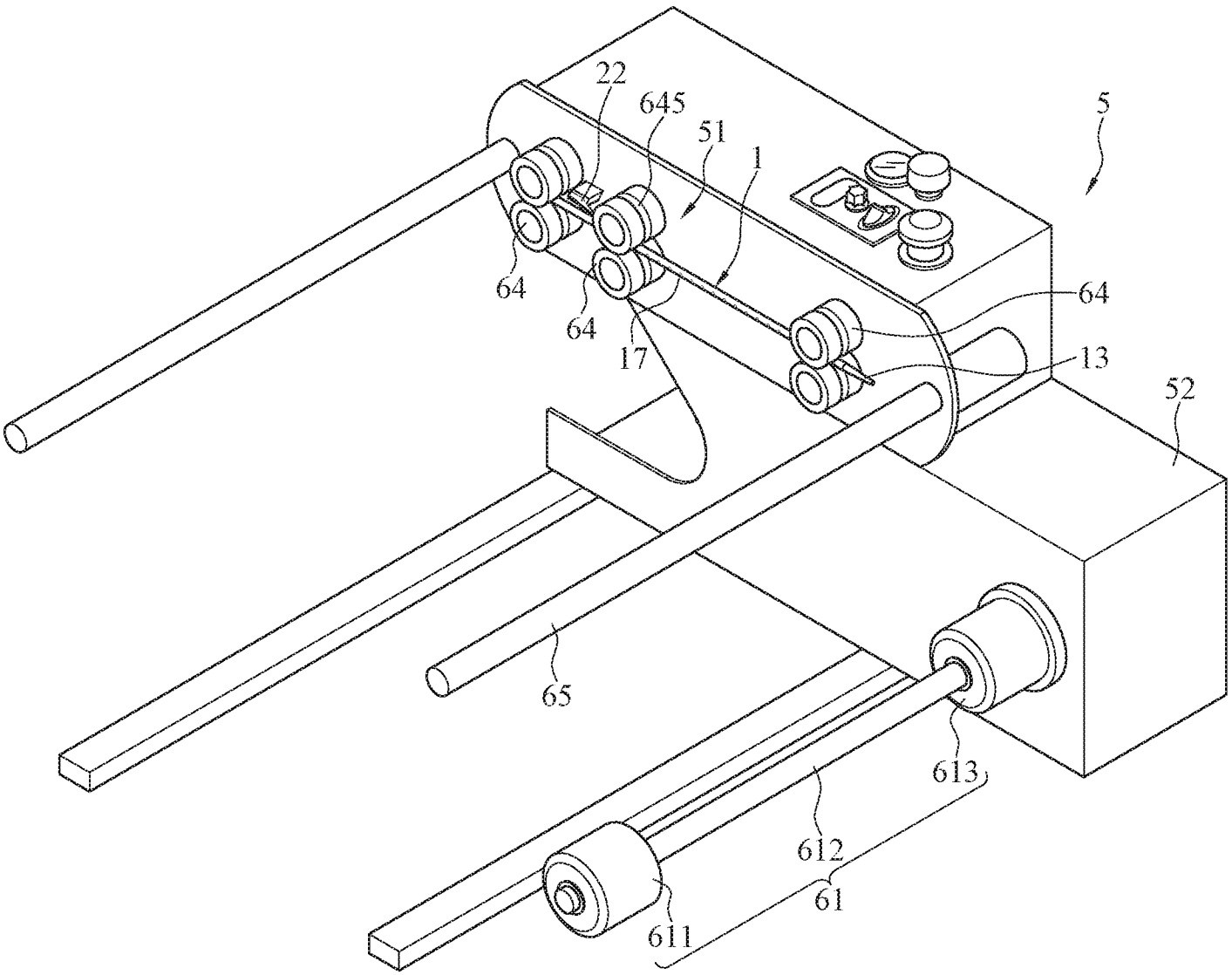
FIG. 20 illustrates a perspective view of a processing machine according to the fifth embodiment of the instant disclosure.
Figure 21:
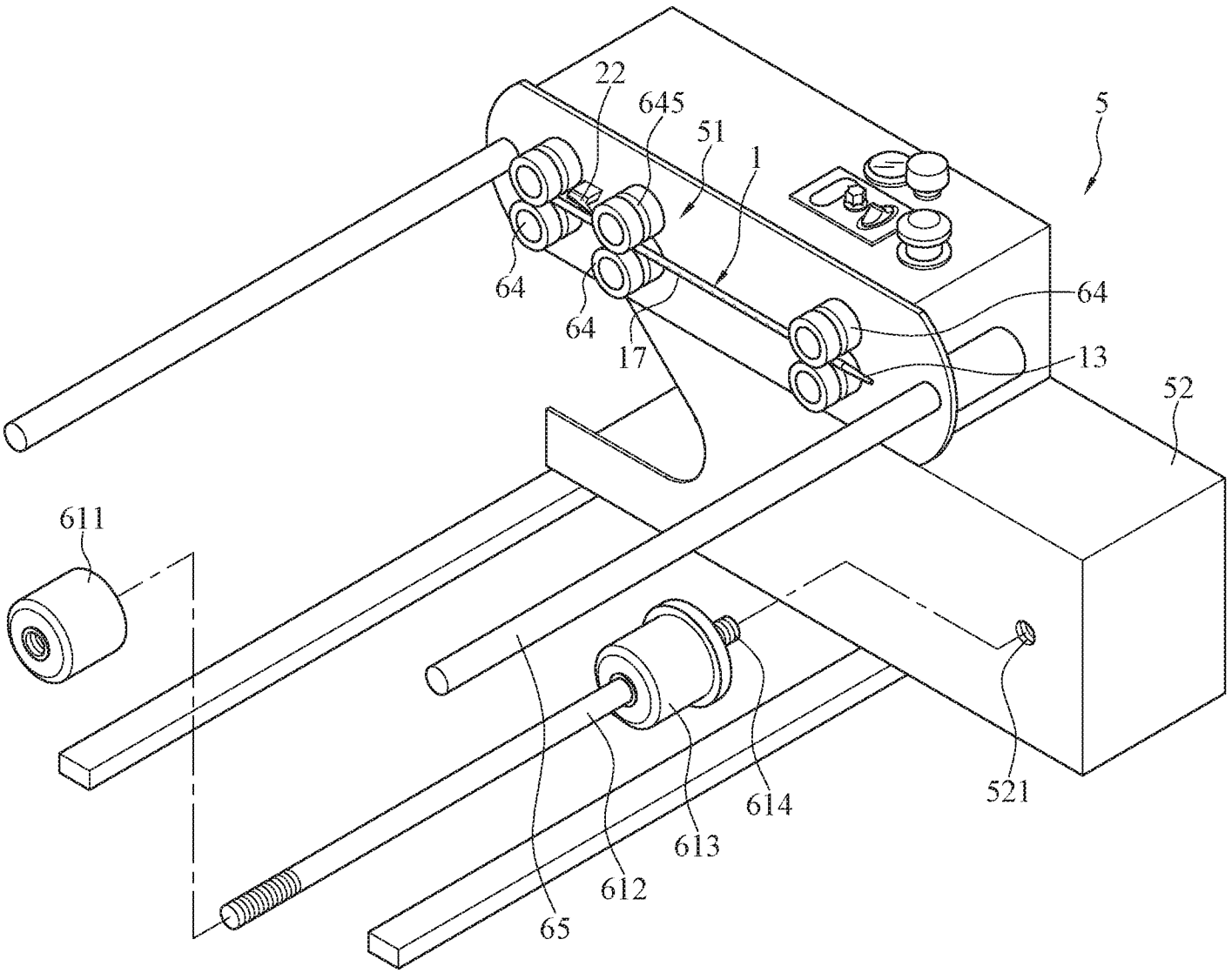
FIG. 21 illustrates a partially exploded view of the processing machine according to the fifth embodiment of the instant disclosure.

Please refer to FIG. 20 and FIG. 21, which are a perspective view and a partially exploded view of a processing machine according to the fifth embodiment of the instant disclosure, respectively. In the embodiment, the processing machine 5 further comprises a base 52. The base 52 comprises a first fixing structure 521 and is disposed on a side of the processing platform 62. The transport wheel 61 comprises a front wheel 611, a shaft 612, and a rear wheel 613. A front end and a rear end of the shaft 612 are provided with external threads. The front wheel 611 is detachably fastened to the front end of the shaft 612. The rear wheel 613 is detachably fastened to the rear end of the shaft 612. The gas sealed body 9 not inflated is rolled and hung between the front wheel 611 and the rear wheel 613. As a result, the distance between the front wheel 611 and the rear wheel 613 can be adjusted by the way of fastening the front wheel 611 and the rear wheel 613 to the shaft 612 to correspond to varied sizes of the gas sealed body 9 not inflated.

In additional, a roll of the gas sealed body 9 not inflated may have varied sizes and thicknesses of the roll and thus may correspond to the transport wheels 61 with varied sizes. The transport wheel 61 comprises a second fixing structure 614 detachably fixed to the first fixing structure 521. The transport wheel 61 can be replaced by another transport wheel 61 with different size by the first fixing structure 521 and the second fixing structure 614 to correspond to the gas sealed body 9 not inflated with different size. In the embodiment, the first fixing structure 521 is a locking hole with an internal thread, and the second fixing structure 614 is a structure of the external thread at the rear end of the shaft 612.

According to the design of the structure of the inflating stick, the cone structure of the front end of the inflating stick is easily inserted into the inflating channel of the gas sealed body to inflate. The front end of the inflating stick that the gas sealed body passes is smooth. The rear end of the inflating stick having a larger size corresponds to films with wrinkles, which facilitates gas flow from the gas outlets to the gas columns. Further, the wrinkles can become smooth so that the cutter can successfully cut the side end of the gas sealed body; therefore, the link rod won't block the side end of the gas sealed body. The gas columns being inflated can be successfully retrieved and reeled in. In addition, the pressing wheels of the processing machine drive the gas sealed body to move forward and press the side end of the gas sealed body. The issue that the gas column may shift due to contraction caused by inflation when the gas sealed body is inflated can be solved.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. A processing machine for processing a gas sealed body having an inflating channel, comprising:

a front platform comprising a transport wheel and a processing platform, wherein the transport wheel is configured to transport the gas sealed body, before the gas sealed body is inflated, to the processing platform;

an inflating stick having:

a body, wherein a front end of the body comprises a guiding segment with a cone structure, and a rear end of the body comprises a packing segment of which an external diameter is greater than that of the guiding segment, wherein the body comprises a gas inlet formed on the packing segment, wherein the body further comprises an internal chamber allowing gas to flow into the body through the gas inlet and a plurality of gas outlets formed on an outer wall of the body allowing gas to flow out of the body, and wherein the packing segment comprises a first locking structure and a second locking structure, the first locking structure and the second locking structure communicating with the gas inlet, and the second locking structure being detachably fastened to the first locking structure, a link rod extending outwardly from the rear end of the body, a cutter disposed in rear of the body and between the packing segment and the link rod, and at least one inflating tube connected to the gas inlet of the packing segment for supplying gas to the internal chamber, wherein the link rod is fixed to the processing platform, and the guiding segment of the body is placeable into the inflating channel of the gas sealed body;

a base comprising a first fixing structure, the base being disposed on a side of the processing platform, the transport wheel comprising a second fixing structure, the second fixing structure being detachably fixed to the first fixing structure; and a rear retrieving rack comprising a retrieving wheel that is configured to retrieve and reel in the gas sealed body after the gas sealed body is inflated, wherein the transport wheel comprises a front wheel, a shaft, and a rear wheel, a front end and a rear end of the shaft being provided with external threads, the front wheel being detachably fastened to the front end of the shaft, the rear wheel being detachably fastened to the rear end of the shaft, so that the gas sealed body, before being inflated, is rolled and hung between the front wheel and the rear wheel.

2. The processing machine of claim 1, further comprising a plurality of pressing wheels, wherein the pressing wheels are next to the inflating stick, and each of the pressing wheels individually presses an upper side and a lower side of the gas sealed body and transports the gas sealed body to the rear retrieving rack horizontally.

3. The processing machine of claim 2, further comprising a rolling shaft between the transport wheel and the processing platform, wherein the rolling shaft drives the gas sealed body to move.

4. The processing machine of claim 2, wherein
the gas sealed body comprises a plurality of films and a plurality of heat-seal lines,
the heat-seal lines seal the films to form a plurality of gas columns that are not inflated,
the gas columns that are not inflated are pressed at the packing segment of the inflating stick,
the gas outlets at the packing segment inflate the gas columns that are not inflated, and
the cutter cuts the heat-seal lines at a side end of the films.

5. The processing machine of claim 2, wherein
the rear retrieving rack further comprises a tension controller and a calculator,
the tension controller controls a tightness of the gas sealed body that is inflated and is retrieved and reeled in, and
the calculator controls a length of the gas sealed body that is inflated and is retrieved and reeled in.

6. The processing machine of claim 1, wherein
the first locking structure comprises a male thread, and
the second locking structure comprises a female thread.

7. The processing machine of claim 1, wherein
the first locking structure comprises a female thread, and
the second locking structure comprises a male thread.

8. The processing machine of claim 1, wherein
the front end of the body is of a cone shape, and
a part of the body from a middle portion thereof to the rear end thereof is a tube.

* * * * *